United States Patent [19]

Mebus et al.

[11] 4,260,145

[45] Apr. 7, 1981

[54] SIGNATURE HANDLING APPARATUS

[75] Inventors: Henry R. Mebus, Nazareth; Leonard Miaskoff, Easton, both of Pa.

[73] Assignee: Harris Corporation, Cleveland, Ohio

[21] Appl. No.: 35,813

[22] Filed: May 4, 1979

[51] Int. Cl.[3] ..... B65H 39/02

[52] U.S. Cl. ..... 270/54; 198/485; 493/359; 493/425

[58] Field of Search ..... 270/54–56, 270/60, 83, 67; 271/184–185, 82, 225; 198/485, 486, 479, 457

[56] References Cited

U.S. PATENT DOCUMENTS

| | | | |
|---|---|---|---|
| 259,978 | 6/1882 | Crowell | 270/83 |
| 2,095,276 | 10/1937 | Wormser | 271/237 |
| 2,998,116 | 8/1961 | Muller | 198/485 |

*Primary Examiner*—Edgar S. Burr
*Assistant Examiner*—A. Heinz
*Attorney, Agent, or Firm*—Yount & Tarolli

[57] ABSTRACT

The disclosed signature handling apparatus is for use with a saddle conveyor which moves signatures with a folded edge up along a path through a series of stations. The apparatus transfers signatures from the saddle conveyor to the infeed conveyor of a signature trimmer in a smooth motion and without abrupt changes in speed or direction. The infeed conveyor to the signature trimmer is located in a plane parallel to and above the path of the saddle conveyor. The apparatus includes a tucker blade mechanism which contacts the folded edge of the signature from below the saddle conveyor. The tucker blade mechanism moves the signature forwardly and upwardly from the saddle conveyor as it moves in a vertical plane through a path which is oblique relative to the saddle conveyor. A gripper finger assembly grips the signature from the tucker blade mechanism and continues the forwardly and upwardly movement of the signature and simultaneously rotates it about an axis parallel to the saddle conveyor. When the gripper finger assembly grips the signature from the tucker blade mechanism, it has a component of motion parallel to the path of the saddle conveyor. The signature is released into the infeed conveyor of the trimmer when it has a component of motion which is perpendicular to the path of the saddle conveyor and in the plane and direction of the trimmer infeed conveyor.

17 Claims, 11 Drawing Figures

SIGNATURE HANDLING APPARATUS

BACKGROUND OF THE INVENTION

The present invention is directed to a signature-handling apparatus. In particular, the present invention relates to an apparatus for transferring signatures between two conveyors which carry signatures.

Typically, signature handling systems include a saddle conveyor which moves signature supports along a path past a plurality of hoppers from which individual signatures are fed. The saddle conveyor conveys the collated group of signatures with their folded edge up to a stitching station where the collated group of signatures is stitched. The signatures are then moved along the path, still with their folded edge up, to a signature transfer station where the signatures are removed from the saddle and moved into a trimmer infeed conveyor. The trimmer infeed conveyor moves the signatures in a direction perpendicular to the saddle conveyor in a plane which is parallel to and above the path of the saddle conveyor. The trimmer infeed conveyor moves the signatures with their folded edge leading.

The transfer of the signatures from the saddle conveyor and into the trimmer infeed conveyor requires not only a change in the direction of movement of the signatures, but also a change in the orientation of the signatures. A conventional method of moving the signatures from the saddle and changing their direction of movement and orientation is shown in U.S. Pat. No. 3,317,026. This patent discloses a mechanism in which the signatures are moved in a step fashion through the stitching station and into a delivery station. A vertically movable blade engages the signature inside the fold of the signature and moves it into the trimmer infeed conveyor. The trimmer infeed conveyor carries the signatures along a path above and transverse to the path of the saddle conveyor. The orientation of the signature is changed so that the folded edge is now leading as it is conveyed by the trimmer infeed conveyor.

The mechanisms for deliverying signatures from the saddle conveyor, such as shown in U.S. Pat. No. 3,317,026, have been satisfactory for collating systems in which signatures are moved in a step fashion, i.e., incrementally, through the stitching station. In such a system, the signatures are stopped when they are stitched and when they are engaged by the vertically moving blade. However, for collating systems where the signature is stapled or stitched while moving, a different delivery mechanism is used.

U.S. Pat. No. 2,998,116 discloses a collating system in which signatures are moved continuously by a saddle conveyor and the signatures are stitched "on the fly", that is, while the signatures are moving. In such a system, transferring the signatures from the saddle becomes somewhat more complicated, because the signatures must be removed from the saddle conveyor while the signatures are moving. In U.S. Pat. No. 2,998,116, a reciprocating blade lifts the signatures from the saddle conveyor and moves the signatures obliquely relative to the saddle conveyor into a series of rollers which continue the oblique movement of the signatures and feed the signatures into a trimmer infeed conveyor.

SUMMARY OF THE INVENTION

The present invention relates to a new and improved signature-handling mechanism. In particular, the present invention relates to a new and improved transfer mechanism for removing signatures from a saddle conveyor and for feeding those signatures into a trimmer infeed conveyor on the fly.

Specifically, the present invention relates to a transfer mechanism which is capable of use in association with a collating system in which the signatures are stapled while they are moving, and must be transferred "on the fly". In accordance with the present invention, a transfer station transfers signatures which are being moved by the saddle conveyor with their folded edge up to a trimmer infeed conveyor which moves the signatures in a direction perpendicular to the direction of the saddle conveyor and oriented with their folded edge leading.

In accordance with the present invention, a reciprocable tucker blade mechanism is used initially to lift the signature from the saddle conveyor. The reciprocable blade mechanism includes a blade which moves in a vertical plane through the path of the conveyor. The tucker blade mechanism moves upward and forward relative to the path of movement of the signature along the saddle conveyor. This oblique path of the reciprocable blade intersects the path of movement of the signatures along the saddle conveyor to enable the blade to move the signatures upwardly and forwardly of a pusher on the saddle conveyor. When the tucker blade assembly first contacts the signature, the two are traveling with nearly the same speed in the direction of the saddle conveyor path although the tucker blade assembly also has an upward component of motion. Thereafter, the signature is lifted upward and forward by the tucker assembly.

A gripper finger assembly grips the signature from the blade and continues the forward and upward direction of movement of the signatures in a smooth action without stopping either the saddle conveyor or the signature. The gripper finger assembly grips the signature adjacent to the folded edge while the signature is moving with a component of motion in the direction of movement of the saddle conveyor. The gripper finger assembly moves along an elliptical path which lies in a plane which is oblique relative to the path of movement of the signatures on the saddle conveyor. In this way the gripper finger assembly turns the signatures from their orientation on the saddle conveyor and tucker mechanism (with the folded edge uppermost) to the orientation in which they travel on the trimmer infeed conveyor (with their folded edge leading on a horizontal path).

Also, the trimmer infeed conveyor carries the signatures at a speed greater than the speed of the saddle conveyor. For this reason, the transfer mechanism must accelerate the signatures from the speed of the saddle conveyor to the speed of the trimmer infeed conveyor. The transfer mechanism of the present invention accomplishes this smoothly without subjecting the signature to excessive or abrupt accelerations. When the gripper finger assembly releases the signature into the trimmer infeed conveyor it is already traveling at the same speed and in the same direction as the trimmer infeed conveyor. Therefore, there are no abrupt forces acting on the signature at that point.

Applicant recognizes that gripper finger assemblies have been utilized to grip signatures and to move them in different directions. Further, applicant recognizes that rotating gripper assemblies have been used to grip signatures and change the direction of movement of the signatures and the orientation thereof. One typical patent disclosing such a system is U.S. Pat. No. 4,066,162.

However, signatures have not been conveyed from a saddle conveyor by a gripper finger assembly which includes gripper fingers supported for rotation about an axis which extends parallel to the path of movement of the saddle conveyor and in which gripper fingers move along an oblique path relative to the path of movement of the saddle conveyor.

BRIEF DESCRIPTION OF THE DRAWINGS

The foregoing and other features of the present invention will become more apparent upon a consideration of the following description of a preferred embodiment of the present invention taken in connection with the accompanying drawings wherein.

DESCRIPTION OF ONE PREFERRED EMBODIMENT OF THE INVENTION

Figure 1:
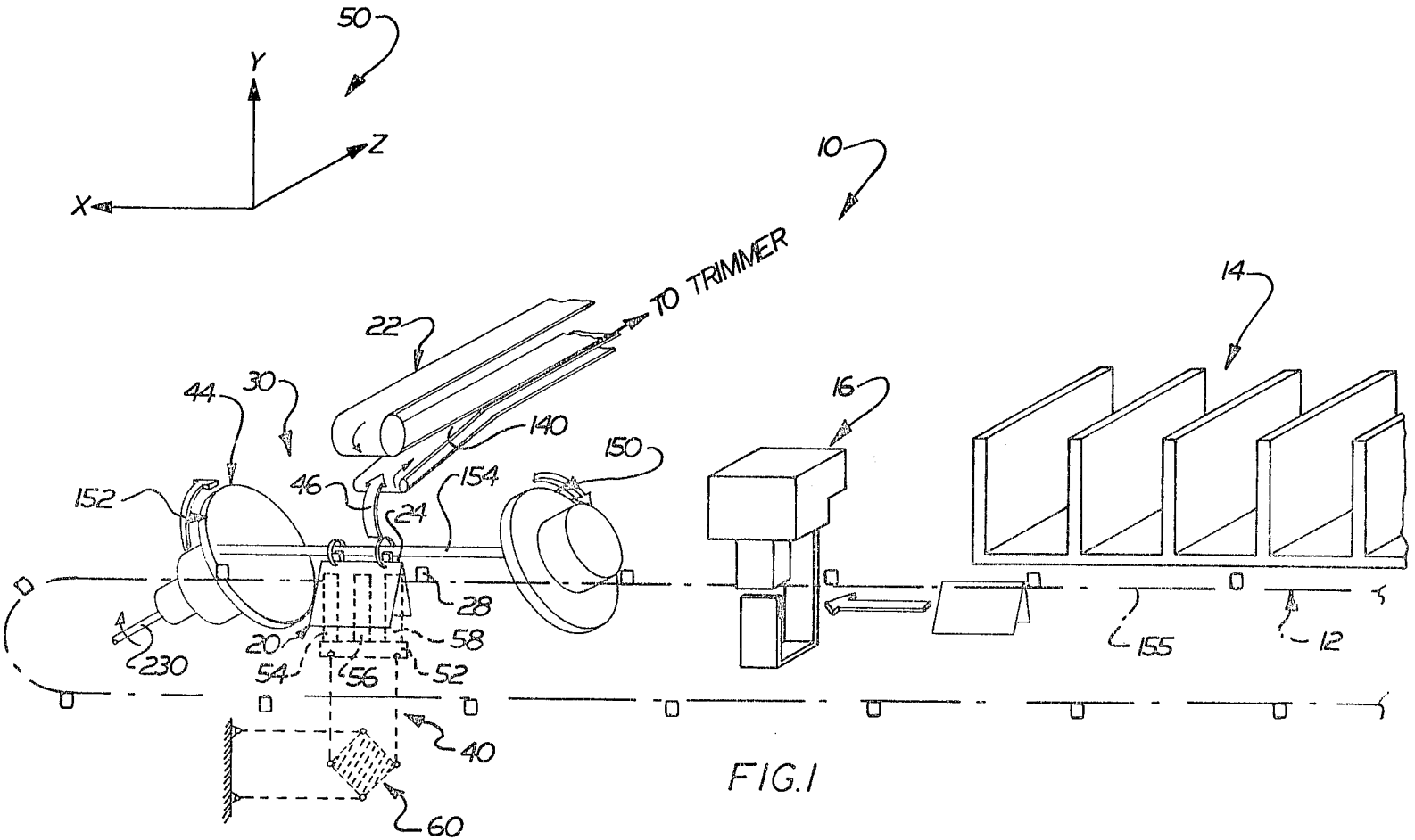
FIG. 1 is a schematic illustration of a transfer apparatus constructed in accordance with the present invention and used in association with a collating station, a stitcher, a saddle conveyor and a trimmer infeed conveyor.

FIG. 1 illustrates a saddle conveyor 12 which carries signatures past a collating station 14 and a stitching station 16. Downstream of the stitching station 16, a collated and stitched signature 20 is transferred from the saddle conveyor 12 to the trimmer infeed conveyor 22. The signature 20 is carried on the saddle conveyor 12 with its folded edge or backbone 24 uppermost, and its foot or trailing edge 26 is engaged by a pusher 28 which is connected with the saddle conveyor 12.

The saddle conveyor 12 moves continuously and carries the signature 20 at a constant speed. The trimmer infeed conveyor 22 is located above the saddle conveyor 12 and conveys the signature 20 on a path which is transverse to the path of the saddle conveyor 12. In addition, the infeed conveyor 22 carries the signature 20 at a higher rate of speed than the saddle conveyor 12. For these reasons a transfer station 30 must lift the signature 20, turn it, and accelerate it from the speed of the saddle conveyor 12 to the speed of the infeed conveyor 22.

When a collated and stitched signature 20 arrives at the transfer station 30 it is lifted from the saddle conveyor 12 and accelerated in a forward direction by the tucker assembly 40. A tucker assembly 40 lifts the signature 20 upwardly and forwardly of the saddle conveyor 12, away from the pusher 28, and accelerates it to the speed, but not the direction, of the infeed conveyor 22. The gripper assembly 44 turns and elevates the signature 20 while carrying it along the elliptical path indicated by the arrow 46 to the infeed conveyor 22. The X, Y, and Z directions are indicated by the mutually perpendicular X, Y, and Z axes 50 of FIG. 1. The axes 50 are conventional, except that the positive X direction has been reversed to coincide with the direction of movement of the signature 20 on the saddle conveyor 12.

Figure 3:
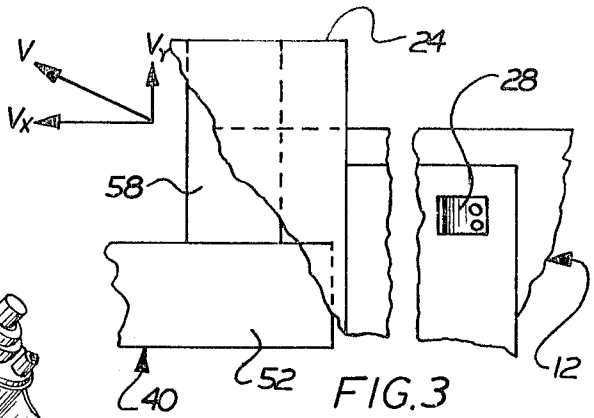
FIG. 3 is an enlarged fragmentary sectional view illustrating the relationship between a pusher on the saddle conveyor and a trailing edge of a signature being moved forwardly and upwardly.

The tucker assembly 40 includes a mechanism 60 which moves the tucker bar 52 and the three tucker blades 54, 56, 58 which are connected to the tucker bar. Movement of the tucker bar 52 is limited to a vertical plane which includes the path of the conveyor 12. When the tucker blades 54, 56 and 58 first contact the bottom of the backbone 24 of the signature 20, the mechanism 60 is moving them with a velocity (V) indicated in FIG. 3. The velocity V has a component in the X direction ($V_X$) and a component in the Y direction ($V_Y$). The component $V_X$ is equal to or slightly greater than the speed of the signature 20 on the saddle conveyor 12. As the tucker blades 54, 56, and 58 continue to lift the signature 20, the component of velocity in the X direction ($V_X$) quickly increases to 1.25 times the saddle conveyor speed to pull the signature ahead of the pusher 28.

The velocity component of the tucker blade in the Y direction ($V_Y$) serves to lift the signature 20 from the conveyor 12. By the time the tucker assembly 40 has moved the signature 20 to a pickup point at which the gripper assembly 44 (FIG. 1) engages the signature, the vertical component $V_Y$ is equal in magnitude to the speed of the infeed conveyor 22.

Figure 4:
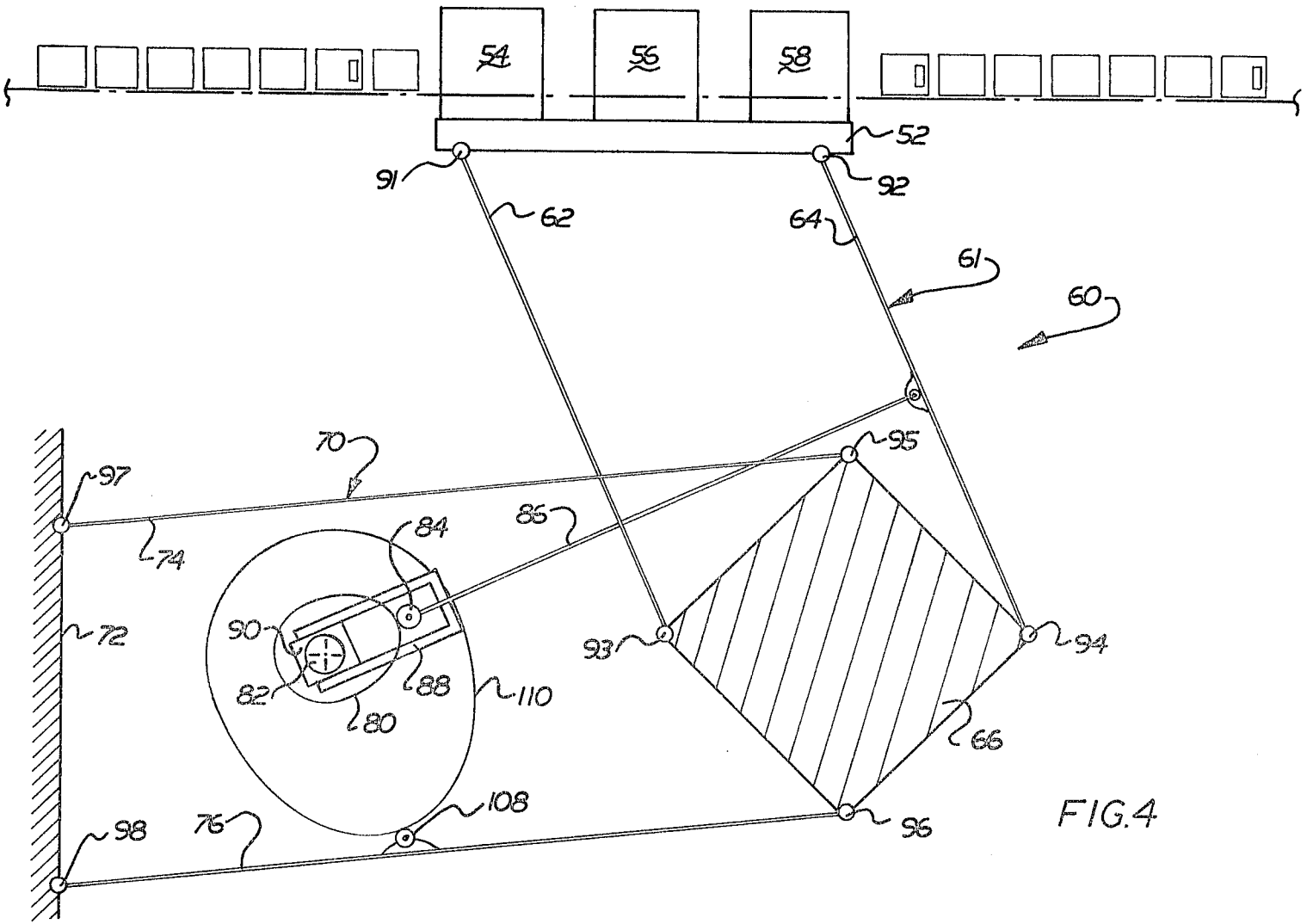
FIG. 4 is a schematic illustration of a tucker bar supported by two four-bar linkages and driven by two cams and used to lift a signature up and forward of a pusher on the conveyor of FIG. 1.

The tucker bar 52 (FIG. 4) to which the tucker blades 54, 56 and 58 are connected is mounted and driven by a mechanism comprising two four bar linkages. The first of these four bar linkages 61 includes the tucker bar 52, vertical links 62 and 64 and star link 66. The second of these four bar linkages 70 includes a portion of the machine frame 72, horizontal links 74 and 76, and the star link 66.

The first four bar linkage 61 is driven by a first cam 80 which is connected with a cam shaft 82 for rotation together therewith. A cam follower 84 is biased by a spring (not shown) to follow the contour of the cam 80 as it rotates. The follower 84 is connected with vertical link 64 by means of a driver link 86 which is pivotably connected with the vertical link 64 near its midpoint. The driver link 86 includes a forked slider 88 which slides on opposite sides of a block 90 which is rotatably connected with the cam shaft 82. In this way when the first cam 80 rotates, the driver link 86 moves axially as the follower 84 follows the contour of the cam, and the axis of the driver link 86 always passes through the center of rotation of the cam shaft 82.

The first four bar linkage 61 forms a parallelogram. Thus the side links 62 and 64 are of equal length. The pivotable connections 91 and 92 at the ends of the vertical links 62 and 64 with the tucker bar 52 are the same distance apart as the connections 93 and 94 on diagonally opposite corners of the star link 66 where the vertical links 62 and 64 are connected. Disregarding for the moment the action of the second four bar linkage 70, rotation of the first cam 80 causes the driver link 86 to reciprocate. This in turn causes any point on the tucker bar 52 or the tucker blades 54, 56 and 58 to trace out an arcuate path. Also, the tucker bar 52 always remains parallel to its initial position.

The second four bar linkage 70 moves the star link 66 so that a diagonal line connecting the opposite corners 95 and 96 on the star link where the horizontal links 74 and 76 are pivotably connected always remains vertical. The horizontal links 74 and 76 are pivotably connected with the machine frame at points 97 and 98. The point 97 is directly above the point 98. In addition, the horizontal links 74 and 76 are of equal length and the points 95 and 96 on the star link 66 are spaced apart the same distance as the points 97 and 98 on the machine frame 72. The second four bar linkage 70 is driven by a cam follower 108 connected with the horizontal link 76. The horizontal link 76 is biased by a spring (not shown) so that the cam follower 108 is urged into engagement with the surface of a second cam 110.

Figure 5:
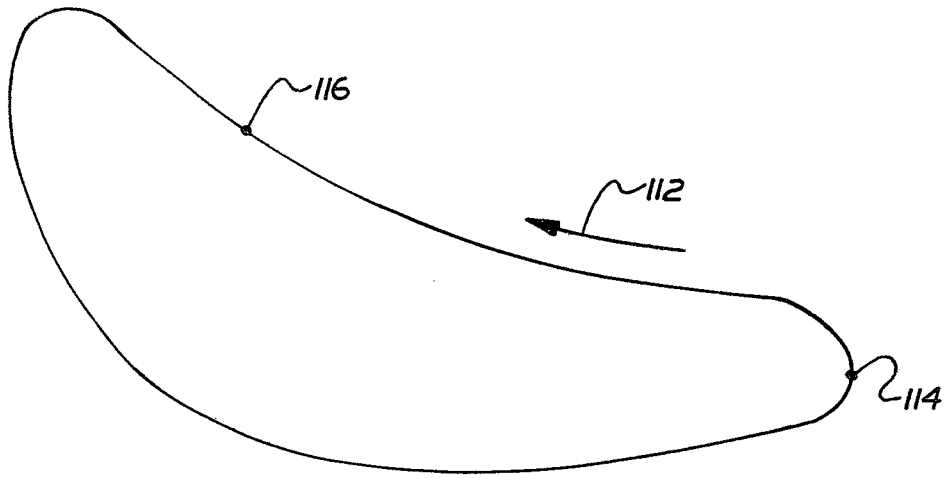
FIG. 5 is a graphic illustration of the path of motion of any point on the tucker bar of FIG. 4.

As a result of the shapes and coordination between the first cam 80 and the second cam 110, any point on the tucker bar 52, or the tucker blades 54, 56 and 58 follows the path shown in FIG. 5 and in the direction of the arrow 112. The first contact which the tucker assembly 40 has with a signature 20 occurs at the point indicated by the numeral 114 in FIG. 4. At this point the tucker bar 52 and the connected tucker blades 54–58 (FIG. 4) have a horizontal velocity ($V_X$) equal to the speed at which the conveyor 12 is carrying the signature 20. By the time the tucker assembly 40 reaches the position indicated by the numeral 116 in FIG. 5, the velocity in the X direction of the tucker bar 52 and connected tucker blades 54–58 has increased to 1.25 times the speed of the conveyor 12. In addition, the signature 20 is given a component of velocity in the Y direction. The component $V_Y$ at point 116 equals or nearly equals the speed of the infeed conveyor 22.

Figure 2:
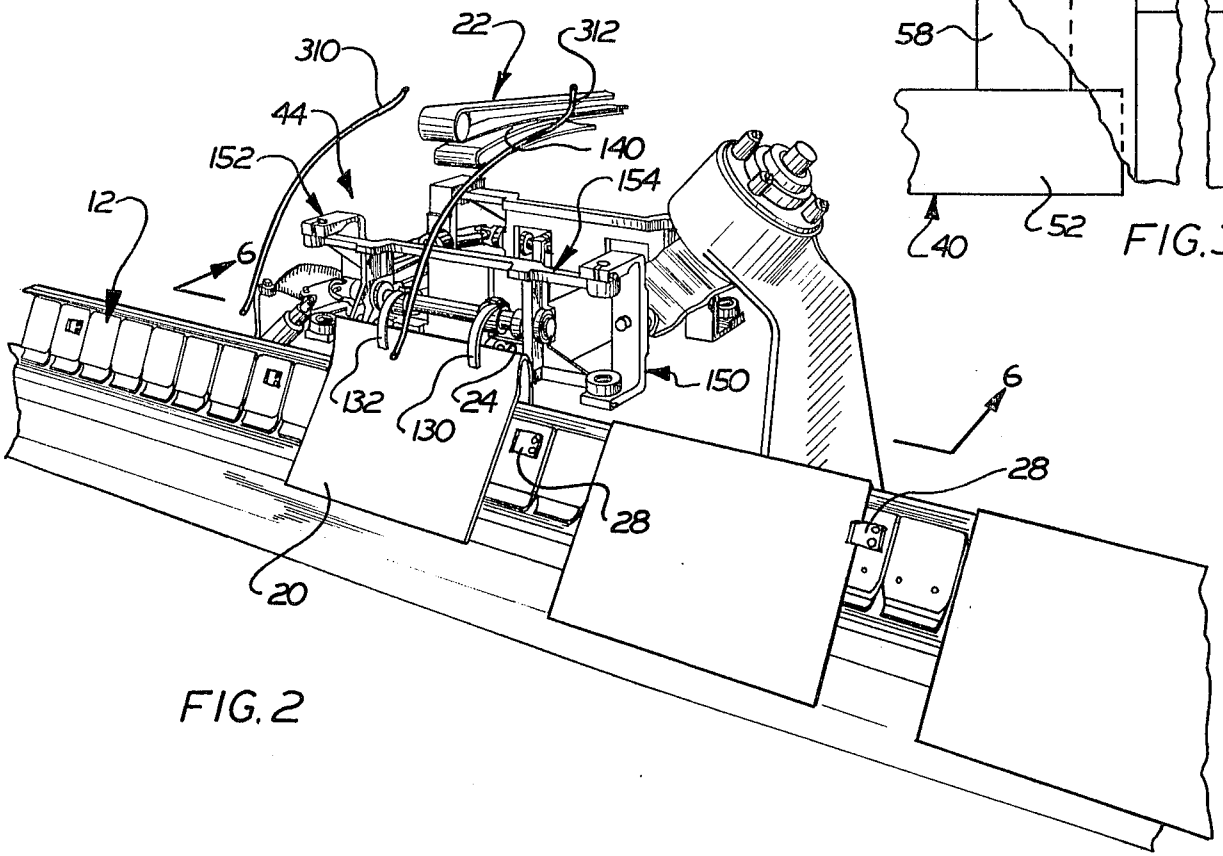
FIG. 2 is a perspective view of the transfer apparatus in the signature handling system of FIG. 1.

At the pickup point 116 illustrated in FIG. 2 the gripper assembly 44 picks the signature 20 from the tucker assembly (hidden by the signature) and lifts and turns the signature, releasing it into the trimmer infeed conveyor 22. When the gripper assembly 44 picks up the signature 20 from the tucker, the gripper assembly 44 has the same speed and direction as the tucker. Therefore, there is no abrupt acceleration nor any excessive force applied to the signature 20.

Figure 8:
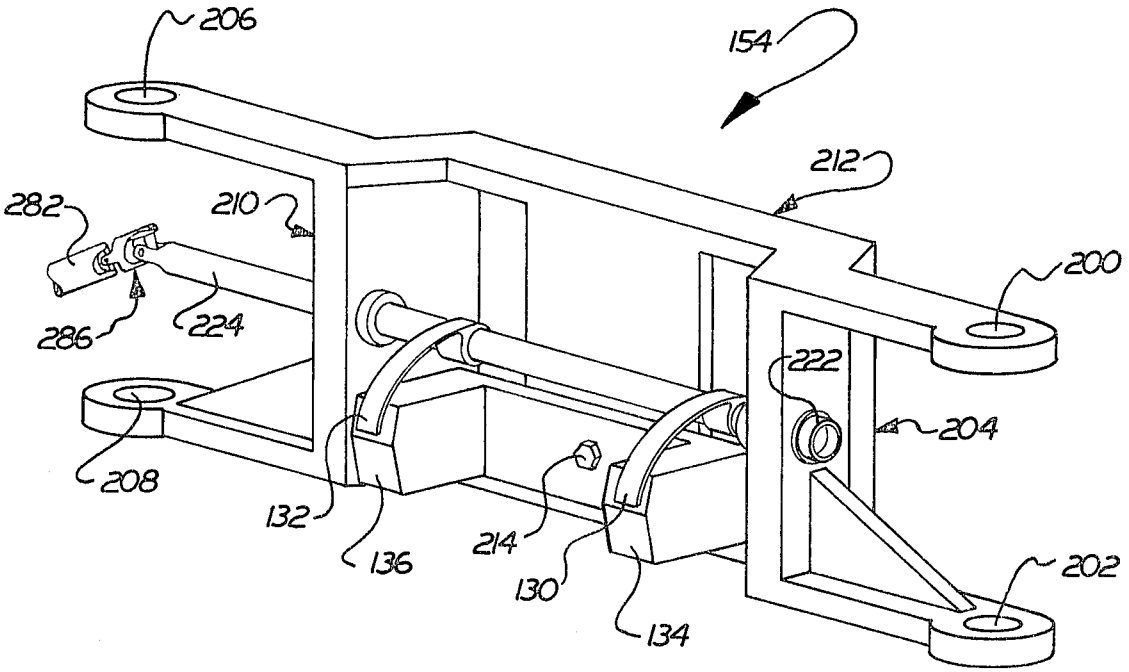
FIG. 8 is a partly schematic perspective illustration of a link which is connected with the frame assembly of FIG. 7 and which forms a part of the gripper assembly of FIG. 6 and showing gripper fingers and pads.

The gripper assembly 44 includes gripper fingers 130 and 132 which are substantially identical. The gripper fingers 130 and 132 cooperate with substantially identical gripper pads 134 and 136 (FIG. 8). The gripper fingers and pads 130–136 are mounted for motion along a quarter-elliptical path indicated by the arrow 46 (FIG. 1). At the beginning of the path 46, i.e., at the pickup point illustrated in FIG. 2, a signature 20 is grabbed and lifted from the tucker assembly 40. The signature 20 is essentially vertical with its backbone 24 uppermost and the leaves extending downward. The grippers and pads 130–136 maintain a grip on the signature 20 until it is delivered to the infeed conveyor of the trimmer 22. The infeed conveyor 22 of the trimmer is downstream from the pickup point, and it is displaced laterally and vertically with respect to the saddle conveyor 12 from the pickup point. A vertical plane through the trimmer infeed conveyor 22 is perpendicular to a vertical plane through the path of the saddle conveyor 12.

The path which the signature 20 follows from the pickup point to the release point at the upstream nip of the infeed conveyor 22 follows a quarter of an ellipse. To achieve this elliptical motion, a pair of substantially identical frame assemblies 150 and 152 are mounted for rotation in parallel planes. The gripper fingers and pads 130–134 are mounted on a link 154 which extends between the two frame assemblies 150 and 152. The link 154 is pivotably connected with the frame assemblies 150 and 152 and is mounted the same distance away from the axis of rotation of the frame assembly 150 as from the axis of rotation of the frame member 152.

When the frame assemblies 150 and 152 are rotated, any point on the link 154 which connects them follows an elliptical path. FIG. 1 illustrates the frame assemblies 150 and 152 and the link 154 schematically showing the rotatable frame assemblies as discs and the link 154 as a rod extending between them. It will be appreciated that as the frame assemblies 150 and 152 rotate 360° about their respective parallel and offset axes of rotation, any given point on the link 154 traces out an elliptical path.

The frame assemblies 150 and 152 are mounted for rotation in planes which are parallel to each other and skewed with respect to the path of the saddle conveyor 12. A line of intersection between the plane of rotation of one of the frame assemblies 150 and a vertical plane through the path of the saddle conveyor forms an angle of 50°. This can be seen most clearly from FIG. 6 in which the path of the conveyor 12 is indicated by a phantom line 155.

The rotating frame assemblies 150 and 152 (FIG. 2) are positioned so that the gripper pads 134 and 136 and the gripper fingers 130 and 132 rotate about an axis parallel to the path of the saddle conveyor 12. The fact that the planes of rotation of the frame assemblies 150 and 152 are skewed with respect to the above-mentioned path of rotation of the gripper fingers 130 and 132 and gripper pads 134 and 134 causes the gripper fingers and pads to reciprocate parallel to that axis as they are rotated. The combination of rotation on reciprocation results in an elliptical path.

The path of the gripper pads 134 and 136 passes tangent or nearly tangent to the vertical plane of motion of the tucker bar 52 and the tucker blades 54, 56 and 58. When the frame assemblies 150 and 152 are driven at a constant anglar velocity, the velocity of the gripper pads 134 and 136 matches the velocity of the tucker bar 52 when the pads are at the point of tangency with the tucker travel path. This point is the pickup point. In this way there is no abrupt jerking of the signature 20 as the fingers and pads 130–136 close around the signature 20 to remove it from the tucker assembly 40.

Also at the pickup point, the velocity components of the gripper pads 134 and 136 in the X and Y directions are at a maximum, and there is no velocity in the Z direction. This is inherent in the geometry of the gripper assembly 44. At the point of release of the signature 20 into the nip 140 of the trimmer infeed conveyor 22, the X and Y components of the velocity of the gripper pads 134 and 136 are 0, and the Z component of velocity (which is in the direction of the path of the trimmer infeed conveyor 22) is at a maximum. Furthermore, at the release point the component of velocity in the Z direction, in the direction of the trimmer infeed conveyor 22, is equal or nearly equal to the velocity of the trimmer infeed conveyor. This assures that there is no abrupt acceleration of the signature 20 as it is drawn into the nip 140 of the trimmer infeed conveyor from the gripper assembly 44.

The frame assemblies 150 and 152 are alike, and therefore only the frame assembly 150 will be described in detail. However, it is to be understood that the description of the frame member 150 applies equally to the frame member 152. The frame assembly 150 (FIGS. 6 and 7) includes a center yoke 170 which is fixed for rotation together with a shaft 172. The shaft 172 rotates about its central axis in a bearing 174 which is fixedly connected with the machine frame 72.

The yoke 170 carries a shaft 176 in bearings 178 and 180. The shaft 176 is free to rotate within the bearings 178 and 180 but is restrained against axial movement. The bearings 178 and 180 support the shaft 176 perpendicular to the axis of rotation of the shaft 172. The shaft 176 carries yokes 182 and 184 at each end. The yokes 182 and 184 are substantially identical, and consequently only the yoke 182 will be described.

Figure 6:
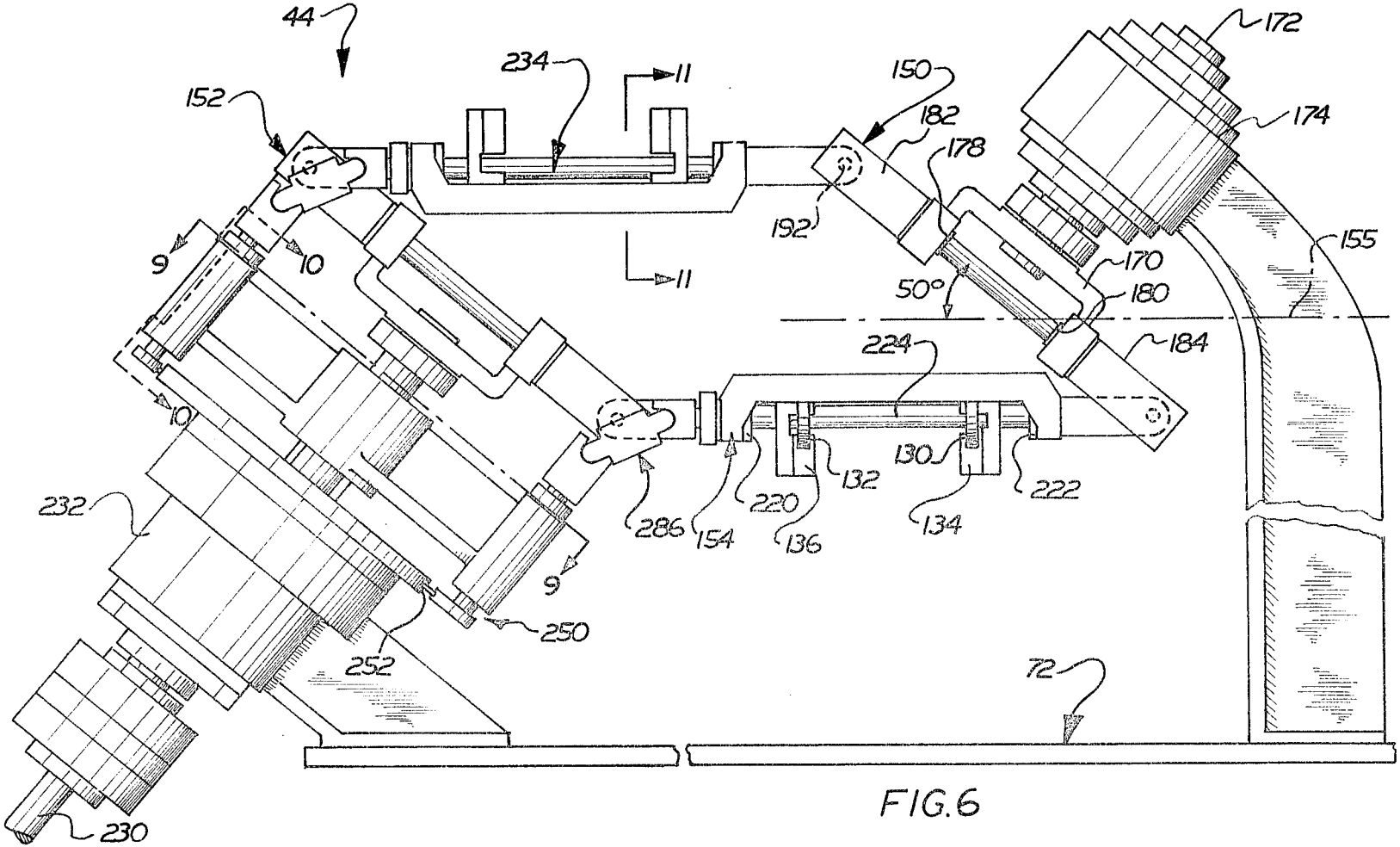
FIG. 6 is an elevation view of a gripper assembly which forms a part of the transfer apparatus of FIG. 2, the gripper assembly being shown rotated 90° from the position illustrated in FIG. 2.
Figure 7:
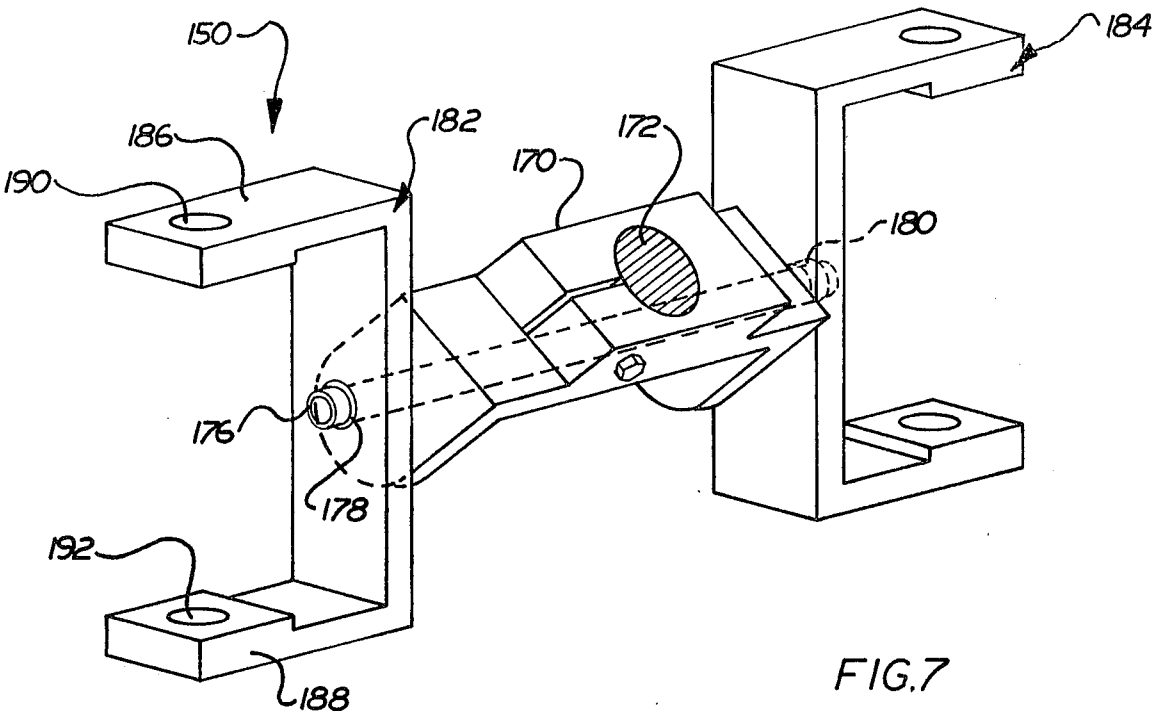
FIG. 7 is a perspective illustration of a frame assembly which forms a part of the gripper assembly of FIG. 6.

The yoke 182 (FIG. 7) has a pair of spaced apart parallel arms 186 and 188. The arms include cylindrical passages 190 and 192 which are aligned with an axis perpendicular to the axis of the shaft 176. The link 154 (FIGS. 6 and 8) is connected with the frame assembly 150 by means of pins which fit the cylindrical passages 190 and 192 (FIG. 7) and cooperate with similar passages 200 and 202 (FIG. 8) in the one end portion 204 of the link 154. Pins (not shown) cooperate with similar cylindrical passages 206 and 208 in the opposite end portion 210 of the link 154 serve to join the link with the frame assembly 152 (FIG. 6).

It will be appreciated by those skilled in the art that the yokes 170, 182 and 184, the shaft 176, and the pins connecting the yokes 182 and 184 with the links 154 and 234 cooperate to form pivotable connections between the links 154 and 234 and the frame assemblies 150 and 152. It is contemplated that other types of pivotable connections could also be used.

The central portion 212 of the link 154 provides a support for the gripping pads 134 and 136 which are mounted thereto in any suitable manner such as by bolt 214 (FIG. 8). In addition, the central portion 212 of the link 154 is provided with aligned cylindrical bearings 220 and 222 which support a shaft 224 to which the gripper fingers 130 and 132 are connected. When the shaft 224 rotates, the tips 226 and 228 of the gripper fingers 130 and 132, respectively, move toward or away from the gripper pads 134 and 136.

The drive of the gripper assembly 44 (FIG. 6) is accomplished through shaft 230 which is connected by a transmission (not shown) with the drive of the conveyor 12. The shaft 230 is fixedly connected with the rotatable frame assembly 152 and is mounted for rotation in bearings 232. Rotation of the input shaft 230 causes the frame assembly 152 to rotate about the axis of the shaft 230. This in turn drives the link 154 and the identical link 234, and these in turn cause the frame assembly 150 to rotate about the axis of the shaft 172.

As previously noted, the axes of the shaft 172 and 230 on which the frame assemblies 150 and 152 are mounted are parallel to each other and spaced apart. They lie in a vertical plane parallel to the path 155 of the conveyor 12. As the frame assemblies 150 and 152 are rotated, the links 154 and 234 follow an elliptical path. The gripper fingers 130 and 132 cooperate with the gripper pads 134 and 136 and grab a signature 20 (FIG. 1) from the tucker assembly 40 at the point where the path of the gripper pads 134 and 136 are adjacent, that is tangent or nearly tangent, with the plane of the tucker stroke. The signature is then moved through a path which follows one quarter of an ellipse and is released to the trimmer infeed conveyor 22. The shaft 230 is driven at a speed so that the velocity of the signature 20 carried by the gripper assembly 44 is within 5% of the speed of the trimmer infeed conveyor 22 when it is released into the nip 140. This reduces forces on the signature which tend to tear or bend leaves.

To summarize, the gripper assembly 44 takes a signature which has been accelerated to the same speed as the speed of the infeed conveyor 22 by the tucker assembly 44 and moves it around a quarter elliptical path. The signature is grabbed at the pickup point which is adjacent to and above the path of the conveyor 12. The gripper assembly 44 takes the signature downstream from the pickup point, elevates it to the level of the trimmer infeed 22, turns it so that its backbone or folded edge 24 leads down the trimmer infeed conveyor 22, and releases it at a point adjacent the nip 140 of the trimmer infeed conveyor.

Figure 9:
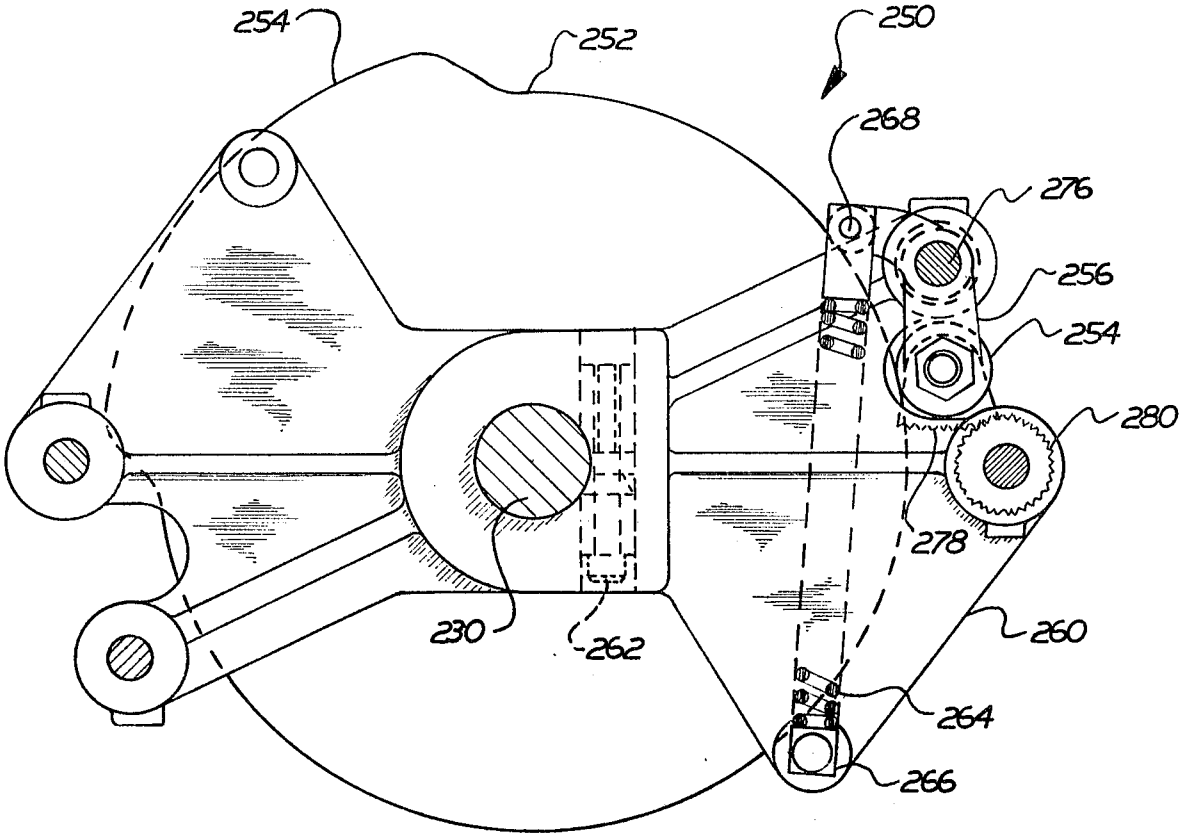
FIG. 9 is a plan view taken along line 9—9 of FIG. 6 and showing a cam assembly used to operate the gripper fingers of FIG. 8.

The gripper fingers 130 and 132 are operated from a closed position to an open position by means of a cam and follower mechanism 250 illustrated in FIG. 9. The cam and follower mechanism 250 includes a cam 252 which is fixed to the bearing 232 (FIG. 6). The cam 252 (FIG. 9) includes a single lobe 254 which extends around approximately 90° of the periphery of the cam 252. A cam follower 254 rides on the surface of the cam 252, and its motion is eventually transmitted to the shaft 224 (FIG. 6) on which the gripper fingers 130 and 132 are mounted.

The cam follower 254 is rotatably mounted on a pivot arm 256 which is in turn pivotably connected with a support plate 260. The support plate 260 is connected by means of a bolt 262 to the input drive shaft 230. When the input drive shaft 230 is rotated, the support plate turns, carrying the cam follower 254 on the end of the pivot arm 256 around the surface of the cam 252.

A spring 264 extends between a boss 266 on the support plate 260 and a boss 268 on the pivot arm 256 to bias the cam follower 254 against the contour of the cam 252. The pivot arm 256 is mounted for rotation about a shaft 276 which is fixedly connected with a support plate 260. The distal end portion of the pivot arm 256 includes gear teeth 278 which mesh with the teeth on a gear 280. As the support plate 260 rotates around the cam 252 and the cam follower 254 rises and falls following the contour of the cam, the pivot arm 256 oscillates about the axis of the shaft 276, and this in turn causes the gear 280 to be turned first in one direction and then in the other direction by the interaction of teeth 278 with the teeth on the gear 280. It is the rotation of the gear 280 first in one direction and then in the other which is transmitted to the shaft 224 on which the gripper fingers 130 and 132 are mounted and which ultimately causes the gripper fingers to grasp and release the signature.

Figure 10:
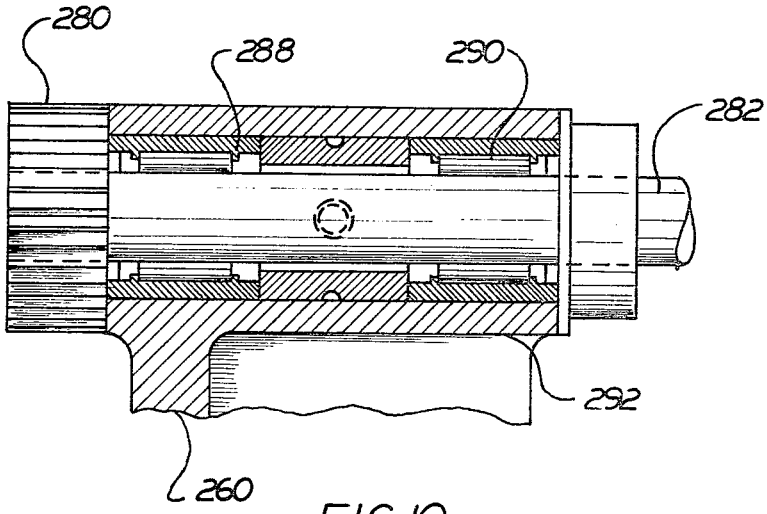
FIG. 10 is a partly sectional view taken along line 10—10 of FIG. 6 and showing a portion of the cam assembly of FIG. 9.

The motion of the gear 280 (FIG. 10) is transmitted through a shaft 282 and a double universal joint 286 (FIG. 8) to the shaft 224. The shaft 282 (FIG. 10) is mounted by bearings 288 and 290 which are supported by a boss 292 on the support plate 260. When the shaft 282 (FIG. 8) turns first in one direction and then in the other this motion is transmitted through the double universal joint 286 to the shaft 224, and this in turn causes the gripper fingers 130 and 132 to move toward or away from the gripper pads 134 and 136. A double universal joint 286 is required in order to transmit the oscillatory motion of the shaft 282 to the shaft 224 because the rotation of the frame 152 (FIG. 6) and the link 154 causes the angular relationship between these two members to vary as the frame assembly 152 turns.

Figure 11:
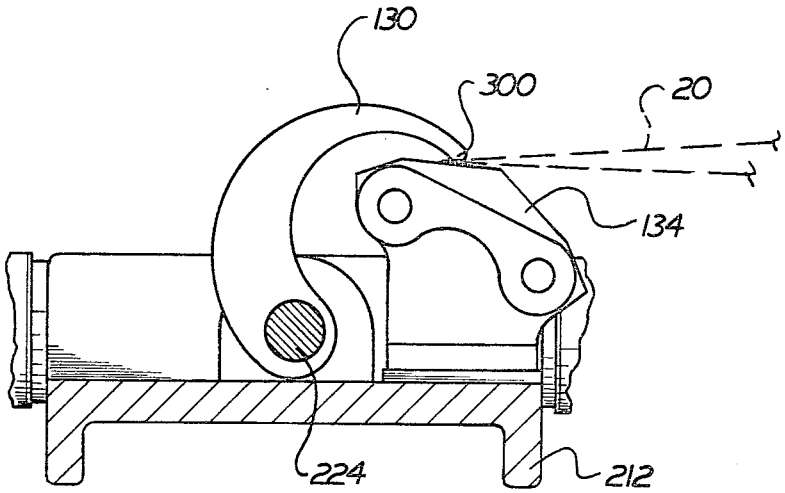
FIG. 11 is a partly sectional view of the gripper fingers and pads of FIG. 8 taken along line 11—11 of FIG. 6.

The gripper fingers 130 and 132 are substantially identical, and therefore only the gripper finger 130 will be described in detail. The gripper finger 130 (FIG. 11) is semi-circular and has a tip 300 which bears against a signature 20 to grip the signature against the gripper pad 134.

A cam 252 (FIG. 10) is shaped to move the tip 300 (FIG. 12) of the gripper finger 130 toward or away from the gripper pad 136 at the appropriate moment. Thus the tip 300 of the gripper finger 130 moves toward the gripper pad 136 to engage a signature 20 when the tucker assembly 40 (FIG. 1) has elevated the signature 20 to the pickup point. Once the gripper assembly 44 has carried the signature 20 to the nip 140 of the infeed conveyor 22, the tip of the gripper finger is moved away from the gripper pad 136 to release the signature into the infeed conveyor 122.

It should be noted that the cam mechanism 250 (FIG. 9) has been described as if it had one cam follower 254 and pivot arm 256 along with the associated gears and springs. However, it is to be understood that each link 154 and 234 (FIG. 6) requires its own cam follower 254, pivot arm 256, gear 280, shaft 282 and universal joint 286. Thus similar parts are provided to operate the gripper fingers on the link 234.

A pair of guide rails 310 and 312 follow the outside contour of the path of the signature 20 from the pickup point to the release point to protect the leaves of the signature 20 from flapping caused by its rapid motion through the air as it is carried by the gripper assembly 44 (FIG. 2).

What is claimed is:

1. An apparatus for handling signatures having a folded edge and for transferring such signatures from a first conveyor continuously moving signatures along a first conveyor path with the folded edge up to a second conveyor conveying the signatures along a path vertically displaced from and transverse to said first conveyor path, said apparatus comprising, a gripper assembly, means for moving said gripper assembly along an oblique transfer path between a signature pickup point adjacent said first conveyor path and a signature release point adjacent said second conveyor path, said means for moving said gripper assembly including means for imparting to said gripper assembly motion having a component parallel to the direction of said first conveyor path at said pickup point and motion having a component parallel to the direction of said second conveyor path at said release point, said gripper assembly including a gripper finger, a gripper pad opposed to said gripper finger, and means for causing said gripper finger and pad to engage a signature therebetween at said pickup point and to release said signature at said release point.

2. An apparatus as set forth in claim 1 wherein said motion of said gripper assembly at said release point is free of any substantial component of motion perpendicular to said component of motion parallel to said second conveyor path.

3. An apparatus as set forth in claim 1 wherein the first conveyor has at least one pusher connected with said first conveyor for engaging a signature and pushing it along said first conveyor path, said apparatus further including a tucker blade for engaging a signature from below said folded edge and means for moving said tucker blade along a path in a vertical plane to lift the signature upwardly and forwardly away from engagement with said pusher and to said pickup point.

4. An apparatus as set forth in claim 3 wherein said second conveyor moves a signature along said second conveyor path at a faster speed than said first conveyor moves signatures along said first conveyor path, said means for moving said tucker blade being effective to accelerate a signature from the speed of the first conveyor to the speed of the second conveyor, and said gripper assembly being effective to maintain said signature moving at the speed of said second conveyor as said signature is moved from said pickup point to said release point.

5. An apparatus as set forth in claim 1 wherein said gripper assembly includes a plurality of said gripper fingers and said gripper pads, said plurality of gripper fingers and pads being spaced from each other to grip a signature at a plurality of spaced locations.

6. An apparatus as set forth in claim 1 further including a plurality of said gripper assemblies, each of said gripper assemblies in turn transferring a signature from said pickup point to said release point.

7. An apparatus as set forth in claim 1 wherein said means for moving said gripper assembly from said pickup point to said release point includes a pair of spaced-apart frame assemblies mounted for rotation in parallel planes which are transverse to said saddle conveyor path, means for rotating said frame assemblies about axes which are parallel and spaced from each other, and a link having opposite end portions pivotably connected with said frame assemblies at locations spaced radially from a respective one of said axes of rotation, said link having an axis extending parallel to said saddle conveyor path, said gripper fingers and gripper pads being connected with said link.

8. An apparatus as set forth in claim 7 wherein said gripper fingers are movable from a closed position in which said gripper fingers grip a signature between tips of said fingers and said gripper pads and an open position in which said gripper fingers are ineffective to grip a signature, and means for operating said gripper fingers between said closed position and said open position.

9. An apparatus as set forth in claim 8 wherein said means for operating said gripper fingers moves said gripper fingers from said open position to said closed position when said gripper assembly is at said pickup point and from said closed position to said open position when said gripper assembly is at said release point.

10. An apparatus as set forth in claim 1 wherein said transfer path between said first conveyor path and said second conveyor path is elliptical.

11. An apparatus as set forth in claim 10 wherein said first conveyor has at least one pusher connected with said first conveyor for engaging a signature and pushing it along said first conveyor path, said apparatus further including a tucker blade and means for moving said tucker blade along a path in a vertical plane to lift the signature upwardly and forwardly from below away from engagement with said pusher and to said pickup point, said second conveyor moving a signature at a faster speed along said second conveyor path than said first conveyor moves a signature along said first conveyor path, said tucker blade moving means being effective to accelerate a signature from the speed of said first conveyor to the speed of said second conveyor, said elliptical path of said gripper assembly being tangent to said vertical plane of motion of said tucker blade at said pickup point.

12. An apparatus as set forth in claim 11 wherein said elliptical path of said gripper assembly is tangent to said path of said second conveyor at said release point.

13. An apparatus for transferring a signature from a first location to a second location, said apparatus including a gripper finger, a gripper pad, means for causing said gripper finger and gripper pad to trace out an elliptical path, said means including means for rotating said gripper finger and pad about an axis spaced from said gripper finger and gripper pad and for reciprocating said gripper finger and gripper pad along a path parallel to said axis of rotation and in synchronism with the rotation of said gripper finger and gripper pad about said axis of rotation, and drive means for causing said gripper finger and gripper pad to engage a signature therebetween when said gripper finger and pad are at the first location and to release the signature when said gripper finger and pad are at a second location.

14. An apparatus as set forth in claim 13 wherein said first location lies in a horizontal plane which includes said axis of rotation of said gripper finger and gripper pad and said second location lies in a vertical plane which includes said axis of rotation of said gripper finger and gripper pad.

15. An apparatus as set forth in claim 14 wherein said horizontal plane includes the minor axis of said elliptical path and said vertical plane includes the major axis of said elliptical path.

16. An apparatus as set forth in claim 15 further including a tucker blade for lifting a signature from a first conveyor to said first location.

17. An apparatus as set forth in claim 16 wherein the first conveyor carries signatures at a constant velocity along a path parallel to said axis of rotation of said gripper finger and gripper pad and said second location is in a nip of a second conveyor, the second conveyor carrying signatures at a constant velocity greater than the magnitude of the velocity of the first conveyor, said gripper finger and gripper pad releasing the signature at said second location with a velocity matching the velocity of the second conveyor, said apparatus further including linkage means controlling the motion of said tucker blade whereby as said tucker blade lifts a signature from the first conveyor to said first location, the signature is accelerated from the velocity of the first conveyor to match the velocity of said gripper finger and gripper pad at the first location.

* * * * *